US007634928B2

(12) United States Patent
Hunt

(10) Patent No.: US 7,634,928 B2
(45) Date of Patent: Dec. 22, 2009

(54) DOOR LOCKING SYSTEM

(76) Inventor: Harry Hunt, 122 Calistoga Rd., #245, Santa Rosa, CA (US) 95409

( * ) Notice: Subject to any disclaimer, the term of this patent is extended or adjusted under 35 U.S.C. 154(b) by 18 days.

(21) Appl. No.: 11/934,474

(22) Filed: Nov. 2, 2007

(65) Prior Publication Data

US 2009/0113956 A1 May 7, 2009

(51) Int. Cl.
*E05B 59/00* (2006.01)

(52) U.S. Cl. ..... 70/107; 70/108; 70/134; 70/120

(58) Field of Classification Search ..... 70/107–109, 70/130, 134, 118, 120
See application file for complete search history.

(56) References Cited

U.S. PATENT DOCUMENTS

| | | | | | |
|---|---|---|---|---|---|
| 536,957 | A * | 4/1895 | Klein | 70/109 |
| 928,904 | A * | 7/1909 | Cottrell | 70/71 |
| 1,277,174 | A * | 8/1918 | Bakst | 70/108 |
| 1,341,038 | A * | 5/1920 | Bickel | 70/116 |
| 1,346,143 | A * | 7/1920 | Teich | 70/108 |
| 2,041,099 | A * | 5/1936 | Williams | 292/341.12 |
| 2,886,960 | A * | 5/1959 | Willett et al. | 70/92 |
| 3,158,016 | A * | 11/1964 | Fay | 70/82 |
| 3,633,389 | A * | 1/1972 | Horgan, Jr. | 70/120 |
| 3,670,537 | A * | 6/1972 | Horgan, Jr. | 70/120 |
| 4,534,192 | A * | 8/1985 | Harshbarger et al. | 70/118 |
| 5,341,752 | A * | 8/1994 | Hambleton | 109/59 R |
| 5,878,606 | A * | 3/1999 | Chaput et al. | 70/108 |
| 5,911,763 | A * | 6/1999 | Quesada | 70/120 |
| 5,915,764 | A * | 6/1999 | MacDonald | 292/66 |
| 6,282,929 | B1 * | 9/2001 | Eller et al. | 70/109 |
| 2002/0104339 | A1 * | 8/2002 | Saner | 70/108 |

* cited by examiner

*Primary Examiner*—Suzanne D Barrett

(57) ABSTRACT

A locking system for integrating into an entry door having a vertical expanse and providing simultaneous multi-port locking along the vertical expanse of the entry door. The locking system includes a rod positioned along the vertical expanse of a length at least co-extensive with a plurality of deadbolt locks positioned within the entry door. A plurality of deadbolt locks that provided space along the vertical expanse and a plurality of swing arms, each swing arm pivotally connected to the rod on first end thereof and connected to a deadbolt lock on a second end thereof. An actuator is employed for shuttling between first and second positions of the rod causing the swing arms to simultaneously extend the deadbolt locks for locking the entry door and withdrawing the deadbolt locks for unlocking the entry door.

7 Claims, 5 Drawing Sheets

DOOR LOCKING SYSTEM

TECHNICAL FIELD

The present invention relates to a lock system for an entry door, and more particularly, the present invention relates to a lock system for integrating into an entry door having a vertical expanse and providing simultaneous multi-point locking along the vertical expanse of the entry door.

BACKGROUND OF THE INVENTION

Currently manufactured residential entry doors provide limited protection from forced entry. Typically, entry doors are constructed of wood, fiberglass, or steel laminate over press board. These doors provide locking through a single deadbolt and latch from the door handle.

The deadbolt and latch, when extended, passes through metal door strikes which are screwed into the doorjamb. These strikes are usually fastened to the jamb with ⅞" wood screws for a latching strike and 3" wood screws for a deadbolt strike.

The jamb is fastened to the structure rough opening with 2½" wood screws on the jamb and hinge sides thereof. The jam is typically ¾" thick finger jointed pine wood. Forced entry through residential doors is accomplished by applying force to the locking area by foot, which dislodges the deadbolt and the latch from the strikes. Typically, the door itself sustains little or no damage. Kicking a door in can be done by 2 or 3 kicks.

To remedy a force entry problem, many residences purchase aftermarket locking devices, such as surface mounted locks or chains. These provide little or no additional protection and are rather unsightly when seen from the inside.

Some residences purchase a steel security door. These steel doors mount in front of the existing door and are fundamentally effective in stopping or delaying forced entry by providing a primary layer of protection from the main door. Steel security doors, however, cost from $200.00 and can rust, causing a maintenance issue. They also require the resident to unlock up to four locks to gain entry, and aesthetically, they are not very attractive to look at.

Some new wood, fiberglass, and steel entry doors are very attractive. Many have leaded glass features and cost upwards of $2,500.00. A typical homeowner would not want to cover up his or her new, beautiful, expensive entry door unless for the fear of someone kicking it in to gain entry.

Thus, there exists a need for a locking system that minimizes forced entry through residential doors, is not unsightly, will not rust, and does not require the resident to unlock multiple locks to gain entry.

Numerous innovations for locks have been provided in the prior art that will be described infra. Even though these innovations may be suitable for the specific individual purposes to which they address, they each differ in structure and/or operation and/or purpose from the present invention in that they do not teach a lock system for integrating into an entry door having a vertical expanse and providing simultaneous multi-point locking along the vertical expanse of the entry door.

U.S. Pat. No. 3,390,558 to Tornoe teaches a high security lock for mounting on a door panel having a latch bolt and a deadbolt with inner and outer knobs to reciprocate the latch bolt and an inner thumb turn and an outer key mechanism to reciprocate the deadbolt.

U.S. Pat. No. 4,156,541 to Babb Jr. teaches an interconnecting lock assembly having simultaneously actuated, multiple security deadbolts. A central one forms part of the main lock subassembly, and the others are operated from the main lock subassembly through a special mechanism.

U.S. Pat. No. 4,227,723 to Rosell teaches a latch that includes a case containing a mechanism for actuating a half-turn bolt, and a head plate. At least one half-turn bolt is provided which is mounted to be movable in a direction parallel to the plane of the head plate of the latch.

U.S. Pat. No. 4,353,582 to Eigemeier teaches a door lock with two case parts disposed in parallel opposed relationship. The follower, designed as an injection molded synthetic resin part, is resilient in itself owing to a supported follower portion. The spring for the spring bolt and for the tumbler are formed by a base structure and the support for a fitting to be mounted later on is offered by sleeves which are provided above and below the follower, both at the lock case bottom and at the inside of the lock cover. The spring-like action of the follower is achieved in that the bent follower leg slidingly bears against an inclined supporting surface of an abutment while curving inwardly or outwardly upon radial movement of the follower. Good fit of the lock in the pocket provided in the door is achieved by ribs on the outer surfaces of the lock case. The lock with all its interior parts is fabricated from thermoplastic synthetic resin material.

U.S. Pat. No. 4,671,089 to Fleming teaches a combination door latch and deadbolt assembly that includes a mechanism and a deadbolt mechanism designed for use with doors having a variety of standard size backset and cross bore dimensions. The latch and the deadbolt mechanisms are carried by escutcheons having breakaway tabs at varying diametric positions to fit securely within door cross bores of different standard sizes. The latch mechanism further includes a mounting arrangement for left- or right-hand mounting and positive centering of lever-type door handles, together with a simplified cam-actuated latch retractor. The deadbolt mechanism includes a bolt linkage which provides a desired bolt throw when a relatively small door backset and/or cross bore size is used. The deadbolt mechanism further includes a thumb turn rotatable through ninety degrees between orientations representative of the deadbolt position.

U.S. Pat. No. 4,717,185 to Hartley teaches a security striker plate for a lock assembly upon a door hinged within a doorjamb including a peripheral door stop and interior framing studs that includes a unit body of U-shape including spaced inner and outer mount plates snugly positioned upon the studs and apertured for nailing thereto. A right angular apertured strike plate extends from the inner mount plate, faces the door when closed, and terminates in a right angular door stop lip nested within the door stop and the doorjamb. An anchor plate extending from the lip and underlying the doorjamb is retained thereby and is connected to the outer mount plate.

U.S. Pat. No. 4,861,079 to DeForrest Sr. teaches a multipurpose lock bolt that has a body which includes a bolt hole, a lock shackle hole, and one or more mounting holes. Each of these are formed in the body and pass through the body. The lock shackle hole intersects with, and traverses across, the bolt hole, as do the mounting holes. An elongated bolt is sized and shaped so as to fit into, and slide in, the bolt hole. The elongated bolt includes an alignment hole which is located in the elongated bolt in a direction transverse to the elongated axis of the elongated bolt. The bolt slides in the bolt hole in the body between an unlocked position and a locked position. In the locked position, the alignment hole in the elongated bolt is aligned with the lock shackle hole in the body allowing a shackle of a lock to be passed through both the lock shackle hole of the body and the alignment hole in the elongated bolt to fix the elongated bolt with respect to the body in a locked position.

U.S. Pat. No. 4,885,921 to Sharav teaches a cover for various locks that are often placed a few inches above the door-knob. The cover is an elongated plate spaced from the door and has sidewalls extending almost to the door. The cover has a downwardly extending portion that surrounds the shaft of the door-knob, has a hole through the shaft of the door-knob, and has a hole through which the door-knob passes when the cover is rotated on its hinges to an open position. A jamming device has an indent for receiving the key or handle of one of the locks on the door. The jamming device bears against the shaft of the door-knob and prevents the key or handle of the lock from turning. Hence, the lock remains locked when the jamming device is used.

U.S. Pat. No. 4,921,122 to Bornstein et al. teaches a slide bar locking arrangement for securing a lid to a cabinet to prevent unauthorized access. Hook members extending from the underside of the lid are received in, and engage, a plurality of corresponding apertures defined in a resiliently biased slide bar slidably mounted adjacent an inner wall of the cabinet, thereby securing the lid to the cabinet. During closing of the lid, the sides of the hook members contact the sides of the apertures causing the slide bar to move laterally until the hooks are secured in the apertures. A knob attached to the slide bar extends outside the cabinet and is operable to move the slide bar out of engagement with the hook members so that the lid may be opened. A lock mechanism is provided to secure the slide bar against movement so that the lid cannot be opened until the lock mechanism is unlocked.

U.S. Pat. No. 4,962,653 to Kaup teaches a drive rod lock. The drive rod is moved from a lock cylinder through a step-down gearing between an open position and a closed position and vice versa. A coupling of the step-down gearing to the drive rod is proposed which permits, in the case of rotation of the lock cylinder through 2 degrees to 360 degrees, shifting the drive rod from the open position into the closed position against displacement without a torque being introduced due to the blocking forces into the step-down gearing and thus the lock cylinder.

U.S. Pat. No. 5,003,796 to Tom teaches a door lock which includes a first bolt mounted movably in a housing and biased to a latching position, and an elongated second bolt member lying in a vertical plane and mounted movably below the first bolt. A first actuating plate is provided adjacent the first notched face and turnable about a horizontal axis to push the notched face so that the second bolt is moved to a latching position or an unlatching position. A first locking plate is cooperatively associated with the second bolt and biased to move upward to a position in which the first locking plate locks the second bolt against movement. The second bolt member further has a second notched face in the upper end near the rear end of the second bolt member, and a second actuating plate is provided adjacent to the second notched face to push the second notched face so as to move the second bolt member.

U.S. Pat. No. 5,058,938 to Doring teaches a drive-rod lock that has drive rods which can be displaced by turning a door handle or the like, and a nut associated with the door handle. The nut, held in its basic central position, can be swung out of that position against spring action in the opposite direction. The lock case bears a cuff rail which continues beyond the lock case into freely extending cuff-rail sections behind which there are guided drive rods. The drive rods control additional lock members, for instance swivel bolts, arranged in the region of the cuff-rail sections. These locking members operate both by the turning of the door handle and as a result of release of at least one force accumulator acting on the drive rods. Operation is obtained by means of a release which is actuated upon the closing of the door by the frame or the like, and for a favorable positioning of the release even with a small depth of the drive-rod lock. The release and/or the force accumulator are/is arranged behind the freely extending cuff-rail sections.

U.S. Pat. No. 5,077,992 to Su teaches a door lock that includes a driving cam secured to a first spindle operatively retracting a latch, a follower cam secured to a second spindle operatively retracting a deadbolt, and a linking rod having a first pin formed on a rod end pivotally connected with a cam protrusion formed on the driving cam and having a second pin formed on the other rod end slidably moving in an actuate slot in the follower cam, whereby upon a rotation of an inside knob for rotating the driving cam for retracting the latch, the linking rod will be biased to pull the follower cam for rotating the follower cam to retract the deadbolt for simultaneously retracting both the deadbolt and the latch for opening a door.

U.S. Pat. No. 5,201,200 to Hauber teaches an entry lock assembly including a deadbolt incrementally extendible by successive turns of a key, a slam bolt which is bodily reversible and blocked against retraction by the deadbolt when extended, and a lock face plate which is bodily reversible for rehanding the lock.

U.S. Pat. No. 5,290,077 to Fleming teaches a door lock assembly for multipoint locking of a door. The lock assembly includes a main lock cartridge in combination with one or more remote secondary lock cartridges mounted at one side edge of a door. The main lock cartridge has an actuator for manipulating a plurality of lock members. In one preferred form for use with a hinged or swinging door, the lock members include a plurality of latch bolts movable to a first extended position for normal door latching or to a second and further extended position to function as multiple deadbolts. In an alternate preferred form for use with a sliding door, the lock members include headed latch pins for engaging keeper plates on the adjacent door jamb. In either embodiment, the doorjamb may include the adjacent side edge of a second or semi-active door in a double door entry set. The second door desirably includes a header-sill lock assembly which is maintained in a positively locked condition unless the adjacent door is opened.

U.S. Pat. No. 5,470,115 to Berg et al. teaches a recessed three-point latching mechanism and method for a storage locker and a locker incorporating the same that utilizes a deadbolt system employing a pair of rotary actuated lock rods for engaging the top and bottom of the locker door opening in conjunction with a center latch engaging the doorjamb. A lever, which may include a finger grip, is utilized for simultaneously unlocking the lock rods, unlatching the center latch, and is accessible within a recessed cup. The latching mechanism and method may also include a cam to hold the latching mechanism in a door open position until the door is closed to prevent damage to the locker face by the otherwise extended lock rods. The latching mechanism and method is compatible with either padlocks or a built-in lock secured within the recessed cup.

U.S. Pat. No. 5,490,695 to Shiue teaches a door lock that includes a deadbolt slidably received in a lock case and having a pair of extensions extended outward beyond the lock case. A pair of plates are fixed to the lock case and each has an oblong hole. An actuating wheel is slidably engaged in the oblong holes and includes a pair of teeth for engaging with the extensions. A board is disposed between the plates and has two bulges for forcing the actuating wheel toward one of the plates so as to retain the actuating wheel in place. A resilient member has a throat portion for positioning the actuating wheel in either end of the oblong holes.

U.S. Pat. No. 5,524,941 to Fleming teaches a door lock assembly for multipoint locking of a door. The lock assembly includes a main lock cartridge in combination with one or more remote secondary lock cartridges mounted at one side edge of a door. The main lock cartridge has an actuator for manipulating a plurality of lock members. In one preferred form for use with a hinged or swinging door, the lock members include a plurality of latch bolts movable to a first extended position for normal door latching or to a second and further extended position to function as multiple deadbolts. In an alternate preferred form for use with a sliding door, the lock members include headed latch pins for engaging keeper plates on the adjacent door jamb. In either embodiment, the doorjamb may include the adjacent side edge of a second or semi-active door in a double door entry set. The second door desirably includes a header-sill lock assembly which is maintained in a positively locked condition unless the adjacent door is opened.

U.S. Pat. No. 5,551,263 to Myers et al. teaches a standard "diamond back" lock configuration, as used in drawer locks, that includes a deadbolt with an angled slot. The angled slot provides a camming action which produces the same amount of linear deadbolt motion with 90 degrees of lock plug rotation as a conventional, non-angled slot with 180 degrees of rotation. In addition, since only 90 degrees of rotation is necessary to fully extend or retract the deadbolt, a user can ascertain whether the lock is engaged or not by the relative orientation of the keyway entry. Also, with 90 degrees of lock plug rotation, key retention at the unlocked position can be provided as an added feature of the lock.

U.S. Pat. No. 5,794,844 to Jenkins teaches a multiple point latching system for use with postal box clusters. In particular, the multiple point latching system includes a latch bar, a track member, a plunger assembly, and a plurality of latch plates. The latch bar is slidably coupled relative to a center partition in the postal box and includes a plurality of latches thereon. The latch bar slides in a vertical movement within a track member which is coupled to the center partition of the postal box. The plurality of latches on the latch bar present a plurality of latch points which aggregate to achieve the securement of the postal box cluster. The multiple point latching system further includes a plunger assembly which is coupled to the center partition, and which supplies a force that acts upon at least one master door to thereby force at least one master door open upon an unlatching of the latches. Hence, a single lock having multiple latch points is used to access and subsequently secure the entire postal box cluster.

U.S. Pat. No. 5,878,606 to Chaput teaches a deadbolt lock system for a swinging door which prevents movement of the deadbolts from a locked position to an unlocked position when the door is open. Movement of the deadbolts from an unlocked to a locked position when the door is opened is prevented by a slide plate which is locked into a deadbolt deactivating position by a plunger which is biased outward when the door is opened. The system also provides for an unlocking of the deadbolts and an opening of the door with a single rotation of the inside handle.

U.S. Pat. No. 5,911,763 to Quesada teaches a three point lock mechanism that includes a lower deadbolt which respectively engages the threshold and lintel of a door or other hinged panel in addition to the central jamb deadbolt. The mechanism utilizes a conventional deadbolt lock set for the central jamb deadbolt. A generally circular plate is attached to the lock set to rotate therewith when the lock is turned to lock or unlock the door. An upper and a lower deadbolt actuation rod extend from the plate and serve to actuate respectively the upper and lower deadbolts of the system by a pivoting actuator at each deadbolt. The two rods are pivotally secured to the plate 135 degrees from one another in order to provide an over center weight bias of the rods to urge the upper and lower deadbolts to a retracted position when retracted and to an extended position when extended. The rods are each secured to the plate at a different radius from the center of the plate in order to provide equal linear travel distances for the rods and deadbolts due to the different actuate positions of the rod attachment points.

U.S. Pat. No. 5,975,592 to Lin teaches a lock assembly including a housing, a control mechanism, one pin or two pins supported by the housing for shifting movement of the pin or of the two pins in a direction transverse to the direction of movement of the control mechanism between a locked position and an unlocked position, and a spring for each pin for enhancing the shifting movement of the corresponding pin toward the unlocked position and for automatically returning the corresponding pin toward the locked position upon release of the control mechanism. When the control mechanism is pushed manually, the pressure which is exerted upon pushing the control mechanism compresses the spring around the pin or two pins which each shifts in a direction transverse to the direction of movement of the control mechanism between the locked position and the unlocked position. Meanwhile, shifting of the pin or of the two pins permits the sliding of a cut-out section of the control mechanism until the pin or two pins strike against the cut-out sections of the control mechanism. As soon as the movement is stopped, the pin or two pins which are acted on by the spring assume a position which assures locking. As soon as the control mechanism is released, the pin or two pins immediately and automatically return to the locked position again.

U.S. Pat. No. 6,151,935 to Evans et al. teaches a deadbolt lock and a deadbolt which will extend automatically whenever a container is locked by virtue of a rigid portion of the container engaging a trigger element extending from the end face of the bolt and causing the release of an outer bolt portion. The release of the outer bolt of the bolt assembly allows the outer bolt to project outwardly and to lock the container notwithstanding the fact that the bolt has not been reset by the operator of the lock. The bolt is self-contained and can be substituted into many existing lock mechanisms of the mechanical type and into some of the existing electronic dial combination locks to provide auto-locking.

U.S. Pat. No. 6,178,700 to Mayer Jr. teaches an apparatus for reinforcing a door frame that includes a pair of elongated metal plates extending substantially the length and width of the jambs forming either side of the door frame. Each of the metal plates defines a plurality of attachment holes for attaching the plates individually to the back sides of each of the jambs with fasteners passing there through. In addition, each plate defines a plurality of installation holes for allowing the door frame to be secured in the framed opening. Fasteners pass through the jambs, the installation holes, and into adjacent members of the framed opening. Each plate further defines a plurality of openings along the lengths thereof which allow attachment of appropriate hinges or strike plate to the front side of the corresponding jamb by fasteners passing through the hinges or strike plate, the jamb, the openings, and into an adjacent member of the framed opening.

U.S. Pat. No. 6,557,912 to Truong teaches an apparatus for holding a door. The apparatus includes a body member configured to be coupled to a floor. Further, the apparatus includes a locking member movably coupled to the body member and having an end that is configured to engage the door. Further still, the apparatus includes a stop arrangement coupled to the locking member and configured to hold the locking member in a predetermined position relative to the body member. The predetermined position is associated with a predefined door position such that the holding prevents the door from moving past a predefined door position when the locking member is engaged with the door.

It is apparent that numerous innovations for locks have been provided in the prior art. Furthermore, even though these innovations may be suitable for the specific individual purposes to which they address, they would not be suitable for the purposes of the present invention as heretofore described, namely, a lock system for integrating into an entry door having a vertical expanse and providing simultaneous multi-point locking along the vertical expanse of the entry door.

One such innovation is represented by applicant's previously issued U.S. Pat. No. 7,025,394. The invention of the '394 patent involves a locking system for integrating into an entry door having a vertical expanse and providing simultaneous multi-point locking along the vertical expanse of the entry door. The locking system disclosed therein includes a plurality of conventional deadbolt assemblies, a plurality of pinion gears, and a rack gear. A plurality of convention deadbolt assemblies are positioned along the vertical expanse of the entry door. The plurality of pinion gears are taught to be operatively connected to the plurality of convention deadbolt assemblies, respectively. The rack gear is operatively connected to the plurality of pinion gears so as to allow the plurality of pinion gears to operate simultaneously. Simultaneously operate pinion gears simultaneously operate a plurality of conventional deadbolt assemblies to provide simultaneous multi-point locking along the vertical expanse of the entry door.

Although the invention disclosed and claimed in the '394 patent represented a dramatic advance in the art of door locking systems, it has been recognized that the complexity of a pinion and rack gear assembly and the supporting hardware to operate such an assembly adds complexity to the multi-door locking system which could, under certain circumstances, prove problematic. Not only is such assemblies relatively expensive to produce, but, due to their complexity, it was found that, particularly when a door was repeatedly slammed closed, that the rack and pinion gears would disengage requiring on site servicing.

It is thus an object of the present invention to provide a locking system for integrating into an entry door having the advantages as disclosed in the '394 patent and yet is simpler to manufacture and assemble and be more resistant to misalignment and failure.

It is yet a further object of the present invention to provide a locking system for integrating into an entry door having the advantages as disclosed in the '394 patent and yet is resistant to failure even when entry doors repeatedly slam.

These and further objects will be more readily appreciated when considering the following disclosure and appended claims.

SUMMARY OF THE INVENTION

The present invention is directed to a locking system for integrating into an entry door having a vertical expanse and providing simultaneous multi-point locking along the vertical expanse of the entry door. The locking system comprises (a) a rod positioned along the vertical expanse of a length at least co-extensive with a plurality of deadbolt locks positioned within said entry door, (b) a plurality of deadbolt locks spaced along the vertical expanse, (c) a plurality of swing arms, each swing arm pivotally connected to the rod on a first end thereof and connected to a deadbolt lock on a second end thereof, and (d) an actuator for shuttling between first and second positions of the rod causing the swing arms to simultaneously extend the deadbolt locks for locking the entry door and withdrawing the deadbolt locks from locking the entry door.

DETAILED DESCRIPTION OF THE INVENTION

Figure 1:
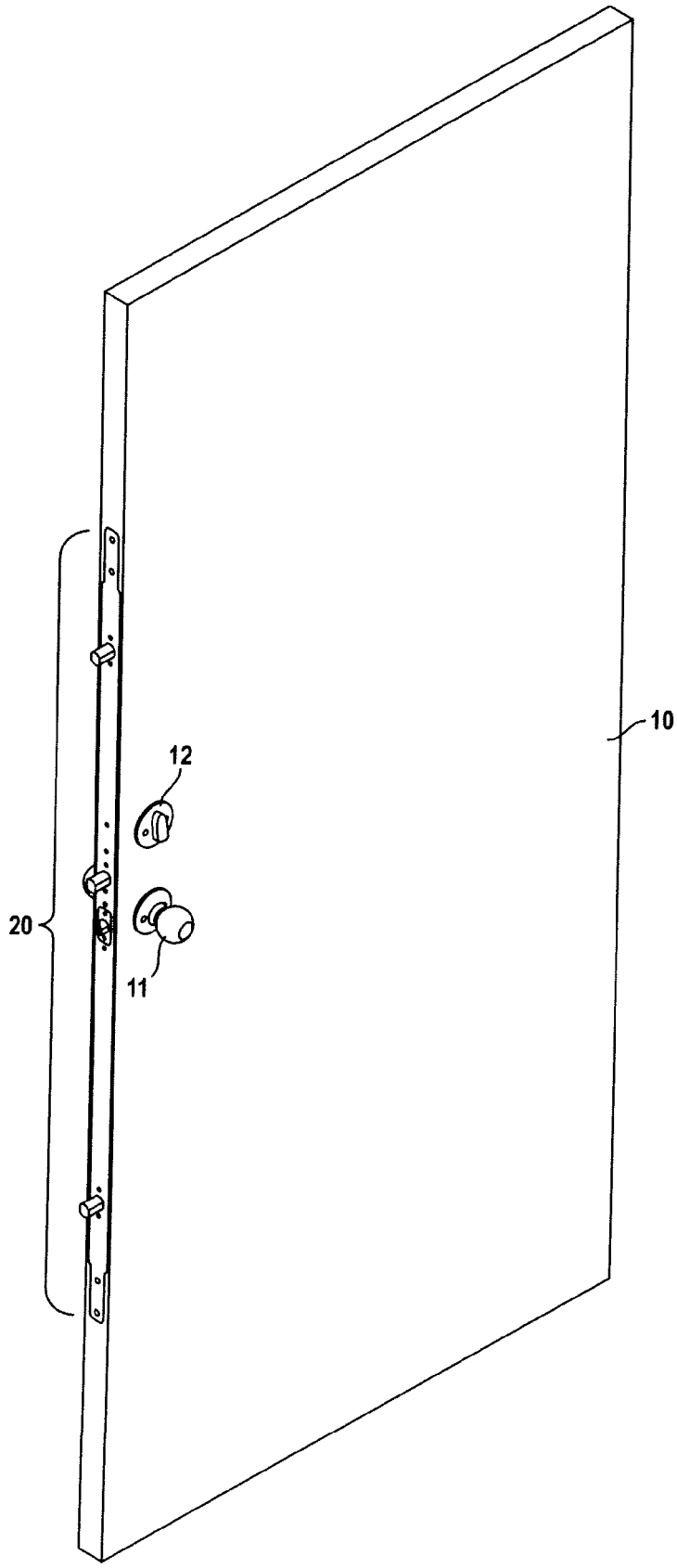
FIG. 1 is a perspective view of an entry door containing the present invention.

Referring now to the figures, in which like numerals indicate like parts, and particularly to FIG. 1, entry door 10 is disclosed which includes typical door knob 11 and deadbolt actuator 12. Normally, actuator 12 would actuate a single deadbolt lock positioned adjacent doorknob 11. However, in this instance, assembly 12, constituting the present invention, dramatically changes the locking function of vertically extending door 10.

Figure 2:
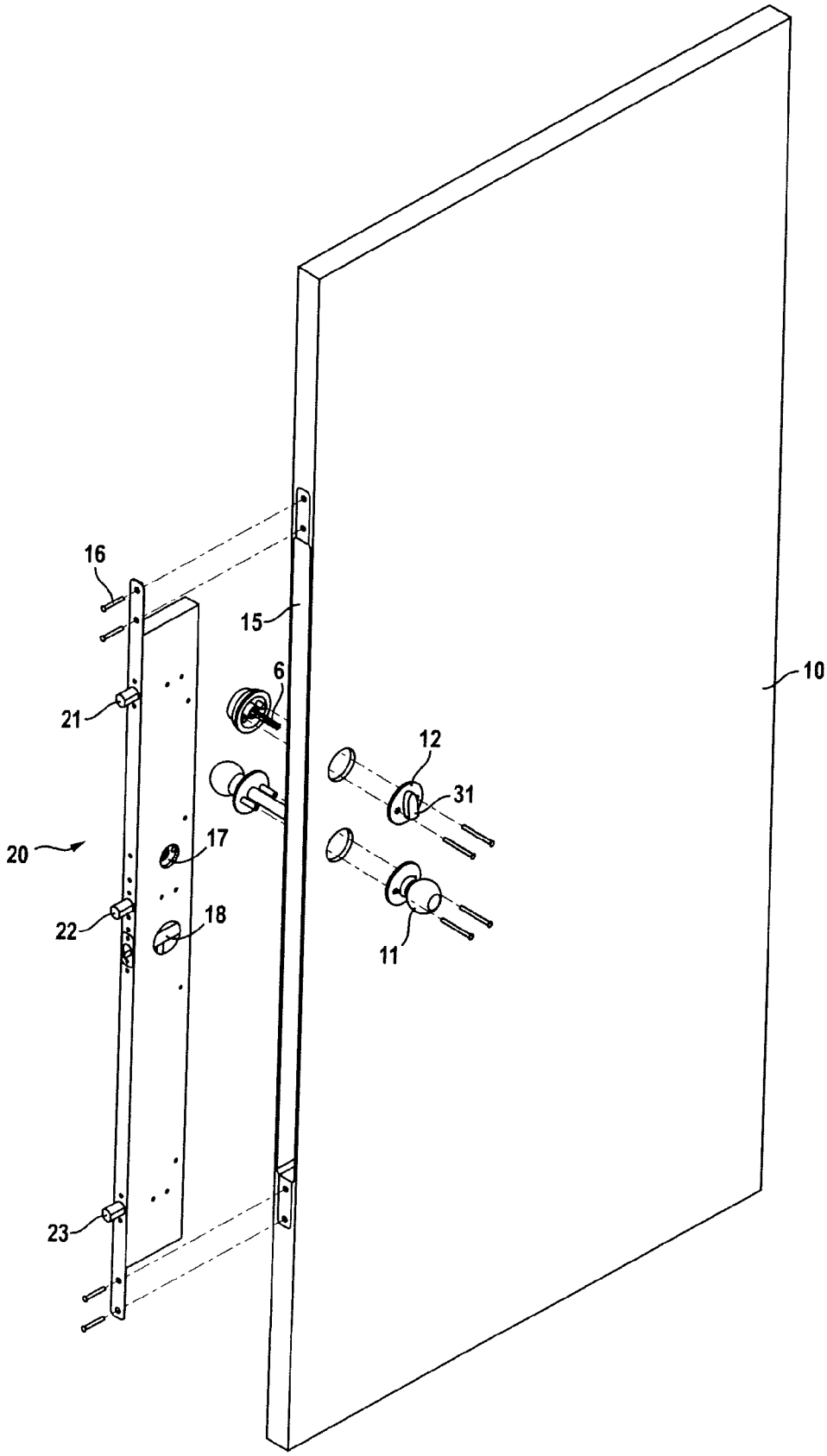
FIG. 2 is a perspective drawing of the entry door of FIG. 1 showing various functional components exploded from their functional positions.

As noted in reference to FIG. 2, entry door 10 can be configured with hollowed out mitered section 15 sized to receive assembly 20, held in place by conventional wood screw 16. Opening 18 in assembly 20 is intended to accommodate conventional doorknob 11 while opening 17 is configured to capture actuator 12. Actuator 12 is intended to constitute a typical deadbolt locking actuator including thumb latch 31 enabling a deadbolt to be locked from the inside of a dwelling and from the outside through a keyed opening (not shown). Either locking option is intended to turn shaft 6 for engaging a locking function.

Unlike the prior art, actuator 12 instead of actuating a deadbolt is anchored to dummy deadbolt 1 and causing shaft 6 to rotate swing arm 5 which, in turn, causes rod 30 to move vertically up and down as suggested by vertically extending arrow 3. This in turn causes slave swing arms 41, 42 and 43 to simultaneously rotate which, in turn, causes deadbolts 21, 22, and 23 to simultaneously extend their bolts to orient between unlocked and locked engagements within a suitable door frame.

Figure 3A:
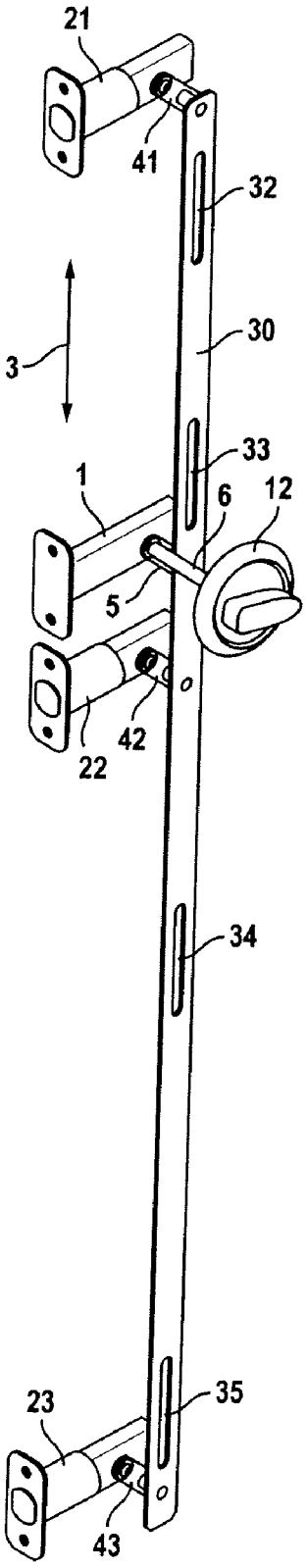
FIGS. 3*a* and 3*b* show the locking system of the present invention in both unlocked and locked orientations.
Figure 3B:
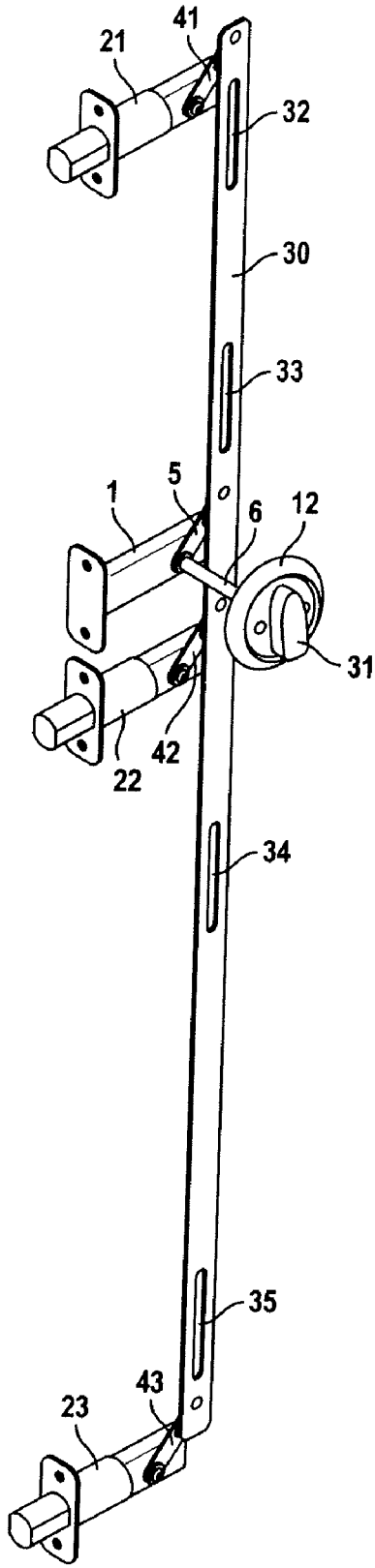
Figure 4A:
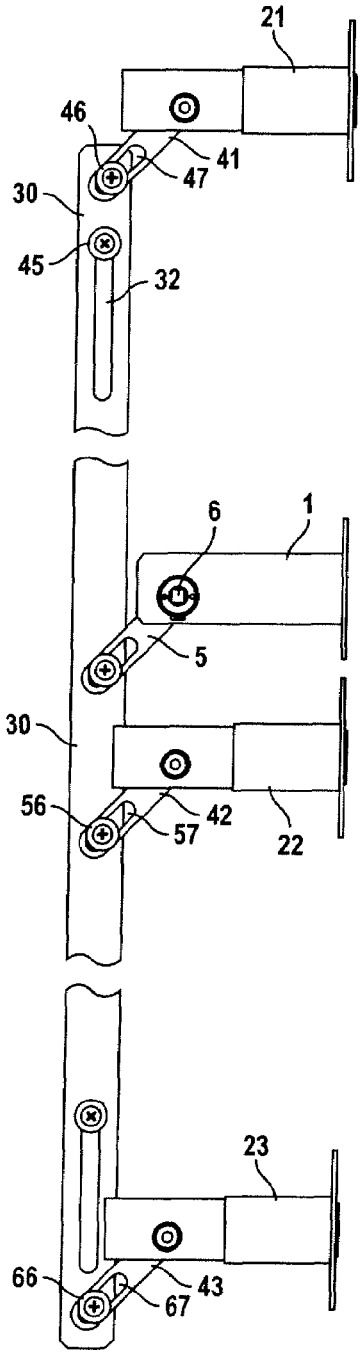
FIGS. 4*a* and 4*b* are plan views of portions of the locking assembly of the present invention showing the orientation of the respective parts to accomplish the described locking function.
Figure 4B:
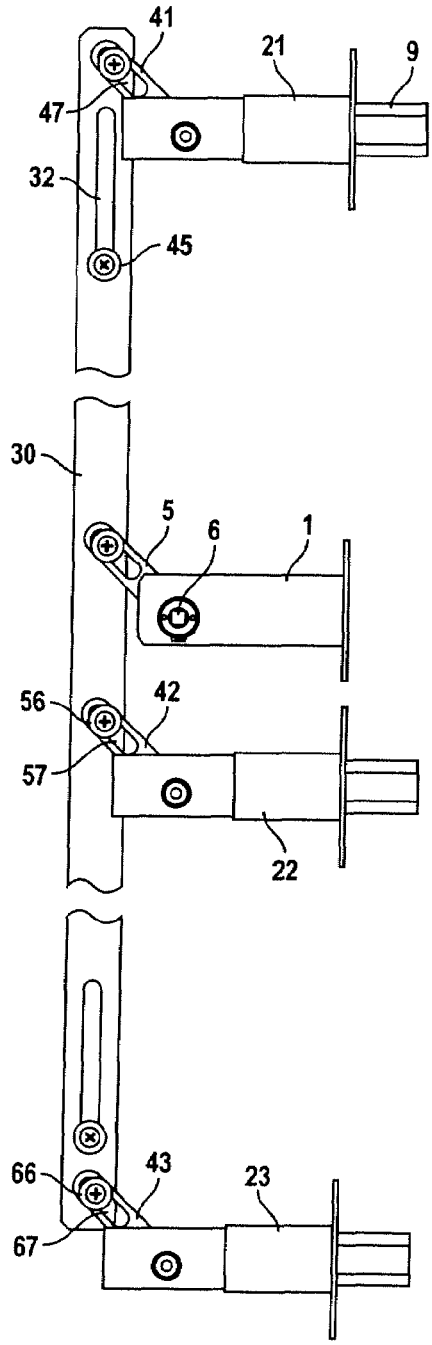

The details of the above-described operation of the present invention can be more readily appreciated in reference to FIGS. 4*a* and 4*b*. As noted, rod 30 is provided with a series of slots 32, 33, 34 and 35 (FIGS. 3*a* and 3*b*) along the longitudinal axis of rod 30. Travel of rod 30 is maintained along this longitudinal axis and is limited by virtue of protrusions 45. Protrusions 45 can be any type of pin or screw assembly including stabilizing washers or shims to ensure that rod 30 remains properly aligned in traveling a predetermined (fixed) distance along the described longitudinal axis of rod 30.

As actuator 12 changes position, swing arms 41, 42 and 43 are caused to rotate about pins 46, 56 and 66 facilitated by configuring openings 47, 57 and 67 in each swing arm 41, 42 and 43. Protrusions 46, 56 and 66 emanate from rod 30 which can again consist of pins, rivets or screws, used alone or with washers or friction reducing spacers causing cam actuators contained in each conventional deadbolt 21, 22 and 23 to turn facilitating the selective extension of deadbolt members 9 thus selectively engaging the locking function.

Figure 5:
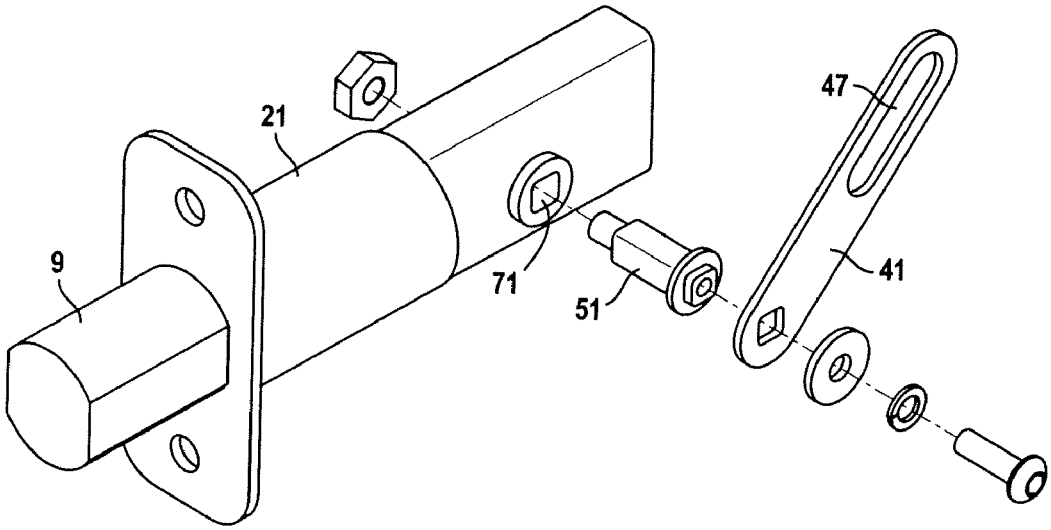
FIG. 5 is a perspective view of a typical deadbolt with the exploded assembly of the swing arm actuator of the present invention associated therewith.

FIG. 5 further illustrates the details of this function. Specifically, it is shown that swing arm 41 containing opening 47 is functionally appended to deadbolt lock 21. Connecting shaft 51 is keyed to deadbolt lock cam opening 71 and retained in position by the various elements shown in exploded view. Thus, as swing arm 41 changes orientation, for example, by moving from a diagonal orientation above horizontal to a diagonal orientation below horizontal, key shaft 51 moves within the cam actuated within lock 21 thus extending or withdrawing deadbolt member 9.

It should be readily appreciated that the decision to describe the present invention employing three deadbolt locks was done for ease of illustration. Certainly, more locks could be employed without departing from the scope of the present invention.

While the invention has been illustrated and described as embodied in a locking system for integration into an entry door having a vertical expanse and providing simultaneous multi-point locking along the vertical expanse of the entry door, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

What is claimed is:

1. A locking system for integrating into an entry door having a vertical expanse and providing simultaneous multi-point locking along the vertical expanse of the entry door, said locking system comprising:

a A continuous rod positioned along said vertical expanse of a length at least co-extensive with a plurality of deadbolt locks positioned within said entry door;

b A plurality of deadbolt locks spaced along said vertical expanse;

c A plurality of swing arms, each swing arm pivotally connected to said rod on a first end thereof and connected to a deadbolt on a second thereof;

d An actuator anchored to a dummy deadbolt causing a swing arm to rotate which in turn causes said continuous rod to move vertically up and down to simultaneously extend said deadbolt locks for locking said entry door and withdrawing said deadbolts from unlocking said entry door.

2. The locking system of claim 1 wherein said continuous rod comprises a flat plate.

3. The locking system of claim 1 wherein said continuous rod is positioned to move vertically within said vertical expanse in response to shuttling said actuator between said first and second positions.

4. The locking system of claim 3 wherein said swing arms are rotatably connected to said continuous rod.

5. The locking system of claim 4 wherein the orientation of said swing aims to said continuous rod change as said actuator shuffles between said first and second positions.

6. The locking system of claim 1 wherein said actuator comprises an exterior keyed deadbolt.

7. The locking system of claim 6 wherein said actuator comprises a thumb latch.

* * * * *